United States Patent [19]

Gallagher

[11] Patent Number: 4,846,383

[45] Date of Patent: Jul. 11, 1989

[54] HANDGUN HOLSTER WITH RESILIENT SPINE

[76] Inventor: Richard N. Gallagher, 4311 W. Van Buren, Phoenix, Ariz. 85043

[21] Appl. No.: 944,453

[22] Filed: Dec. 22, 1986

[51] Int. Cl.[4] ..... F41C 33/02

[52] U.S. Cl. ..... 224/243; 224/911

[58] Field of Search ..... 224/192, 238, 243, 911, 224/912

[56] References Cited

U.S. PATENT DOCUMENTS 2,546,774 3/1951 Ohlemeyer ..... 224/243

4,620,654 11/1986 Cook ..... 224/243

*Primary Examiner*—Renee S. Luebke

*Attorney, Agent, or Firm*—Tod R. Nissle

[57] ABSTRACT

An improved handgun holster. The holster snuggly accommodates a handgun selected from a defined range of sizes and includes an elongate longitudinal spine which resiliently deforms when a gun is placed in the holster. The resilient deformation of the spine facilitates the conforming of the holster to the gun.

1 Claim, 1 Drawing Sheet

HANDGUN HOLSTER WITH RESILIENT SPINE

This invention relates to holsters for handguns.

More particularly, the invention relates to a handgun holster which snugly accommodates a handgun selected from a defined range of sizes and includes an elongate longitudinal spine which resiliently deforms when a gun is placed in the holster, the resilient deformation of the spine faciliating the conforming of the holster to the gun.

In a further respect, the invention relates to a handgun holster having pliable side walls with tapered edges which are attached to the spine of the holster such that when a gun is inserted in the holster, the walls can readily fold rearwardly with respect to the spine and conform to the shape and contour of the gun.

In another respect, the invention relates to a handgun holster having a inner spine surface fabricated from a material which, when the upper portion of a handgun repeatedly slidably contacts the spine surface, resists wear and extends the life of the holster.

Conventional handgun holsters are fabricated by folding a piece of multiple layered material in a U-shape and attaching the rear adjacent edges of the folded material to form a gun receiving opening in the holster. This type of holster is illustrated in U.S. Pat. No. 4,485,947 to Cook. A drawback of this type of holster is that the holster is relatively stiff, and the U-shaped spine of the holster does not readily conform to the upper elongate surface of a handgun, particularly when the juncture of the upper and side walls of the barrel of the gun is squared. The general inability of the spine of such holsters to conform to a gun placed in the holster causes the inner spine surfaces to wear at a rate greater than that of the other inner wear surfaces of the holster. This reduces the useful life of the holster. One solution to this problem, described in U.S. Pat. No. 4,485,948, is to sew a wear-resistant ribbon of fabric over the inner surface of the spine of the holster. During use of the holster the fabric ribbon wears. However, utilization of the wear-resistant ribbon has disadvantages. The ribbon further reduces the ability of the spine to pliably conform to the upper portion of a handgun placed in the holster. As the ribbon wears, the gun sight snags on portions of the ribbon. Finally, during use of a holster the outer surface of the spine undergoes a substantial amount of wear and tear. The multiple layered fabric material used in the construction of conventional holsters is susceptible to being torn and otherwise damaged during such use.

Accordingly, it would be highly desirable to provide an improved handgun holster including a spine which would resist wear, would have a life at least as long as the other inner wear surfaces of the holster, and which would facilitate conformation of the holster to a gun placed in the holster.

Therefore, it is a principal object of the invention to provide an improved protective holster for a handgun.

A further object of the invention is to provide an improved handgun holster having a spine which has a life at least as long as the other inner wear surfaces of the holster and which facilitates conformation of the holster to a gun placed in the holster.

Another object of the invention is to provide an improved handgun holster in which the spine and side walls of the holster are interconnected to one another such that the rearward folding of the side walls with respect to the spine is facilitated.

Still a further object of the instant invention is to provide an improved handgun holster in which the shape and dimension of the inner surfaces of the spine is, when a gun is inserted in the holster, altered to better accommodate the gun sight of the gun.

These and other, further and more specific objects and advantages of the invention will be apparent to those skilled in the art from the following detailed description thereof, taken in conjunction with the drawings, in which.

Figure 1:
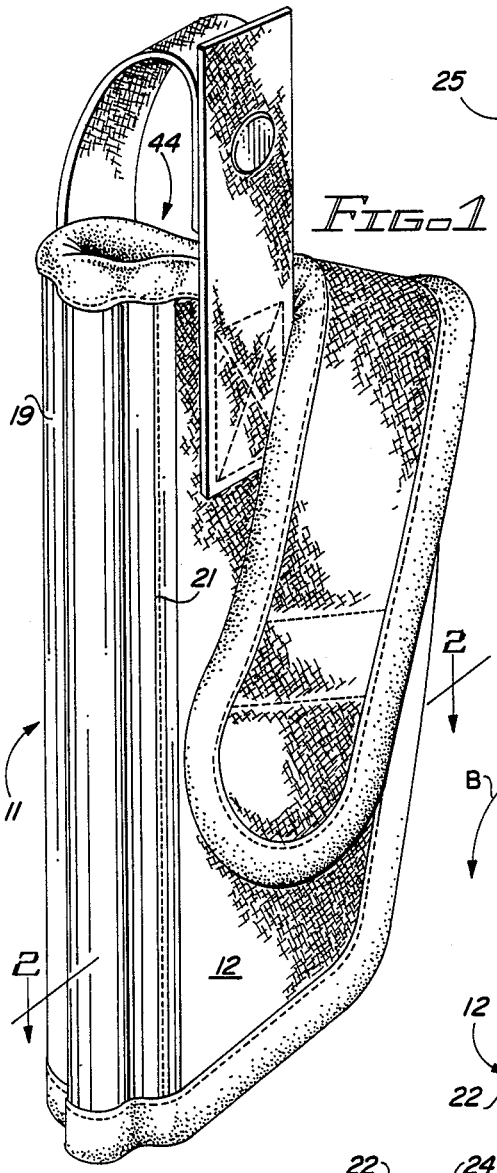
FIG. 1 is a perspective view illustrating a protective holster constructed in accordance with the principles of the invention.

Briefly, in accordance with my invention, I provide an improved protective handgun holster for snugly accommodating a handgun selected from a defined range of sizes. The holster includes an elongate longitudinal spine including a resilient elongate U-shaped channel for receiving the sight of a handgun, and first and second resilient flange means attached to and outwardly extending from the U-shaped channel; and, a pair of side walls each having a forward edge attached to one of the first and second flange means, and extending outwardly and rearwardly folded from the spine to define a gun-receiving opening. The side walls and spine are shaped and dimensioned to receive and grasp snugly a handgun of selected size inserted in the holster, and, when the handgun is inserted, to cause the flange means to be resiliently outwardly displaced by the gun to enlarge the U-shaped gunsight channel.

In another embodiment of the invention I provide a protective handgun holster for snugly accommodating a handgun selected from a define range of sizes. The holster includes an elongate longitudinal spine including first and second longitudinal outwardly extending resilient flange means; and, a pair of side walls each having a tapered forward edge attached to one of said first and second flange means, and extending outwardly and rearwardly folded from and at an inner angle with respect to the spine to define a gun-receiving opening. The side walls and spine are shaped and dimensioned such that when a handgun of selected size is inserted in the holster, the flange means are resiliently outwardly displaced to decrease the inner angle between the walls and flange means, the tapered forward edges of the side walls facilitating the rearward folding of the side walls with respect to the flange means to decrease the inner angle between the flange means and the side walls.

In still another preferred embodiment of the invention I provide a protective handgun holster for snugly accommodating a handgun selected from a defined range of sizes. The holster includes an elongate longitudinal spine including an elongate U-shaped channel for receiving the sight of a handgun, and first and second longitudinal flange means attached to and extending outwardly from the U-shaped channel; and, a pair of pliable side walls each having a forward edge attached to one of the first and second flange means, extending outwardly and rearwardly folded from the spine to define a gun-receiving opening, and including a pliable elastomer memory web defining a layer in the wall and initially resiliently compressing to take on a contour to conform to a gun placed in the holster and to, after the gun is stored in the holster for a period of time, generally permanently retain the contour.

Turning now to the drawings, which depict the presently preferred embodiment of the invention for the purpose of illustrating the practice thereof and not by way of limitation of the scope of the invention and in which like reference characters identify corresponding elements throughout the several views, FIGS. 1–4 illustrates a holster including a spine 11 and side walls 12 and 13 defining gun receiving opening 44. Side walls 12 and 13 are stitched together 14 along their trailing rear longitudinal edges 15 and 16. Spine 11 includes inner U-shaped channel 17 and longitudinal flange means 18-21 outwardly extending from spine 11. Channel 17 receives the sight 46 of a handgun. Inner flange means 18 and 20 are preferably shorter than and extend outwardly a shorter distance from spine 11 than do outer flange means 19, 21. The shorter lengths of flange means 18 and 20 permit side walls 13 and 12, respectively, to be more readily rearwardly folded in the direction indicated by arrows A and B in FIG. 4. Each side wall 13 includes an outer layer or web 22 of a relatively stiff, tear-and-abrasion-resistant fabric like the 12 ounce style N51MLK nylon sold by Howe & Bainbridge of Boston, Mass. The inner layers or webs 23 are preferably formed of a soft-surface fabric, such as the 4-ounce type N40DR nylon material made by Howe & Bainbridge. Intermediate layer or web 24 preferably has a thickness of about 0.25 inch and is formed from a yieldably firm elastomer. The elastomer of layer 24 can comprise an elastic material which compresses and contours to a gun placed in a holster and, because of its excellent retentive memory characteristics, returns to its original shape when the gun is removed from the holster. A closed-cell polyethylene foam made by the Uniroyal Company and identified by catalog No. PE-205 would comprise such an elastic material. Conversely, the elastomer of layer 24 can comprise a material which compresses and contours to a gun placed in the holster and which, after the gun is stored in the holster for a period of time, permanently retains its compressed form. The respective adjacent faces in the interfaces between layers 22–24 are bonded together by an adhesive or any other suitable means. Walls 12, 13 can be made with one or more layers of material, provided the material is somewhat pliable and the forward longitudinal leading tapered edges 25 can be inserted between flange means 21, 20 and 18, 19, respectively, and the walls 12, 13 rearwardly folded in the direction of arrows B and A to be attached with stitching 14 or other appropriate attachment means.

Figure 2:
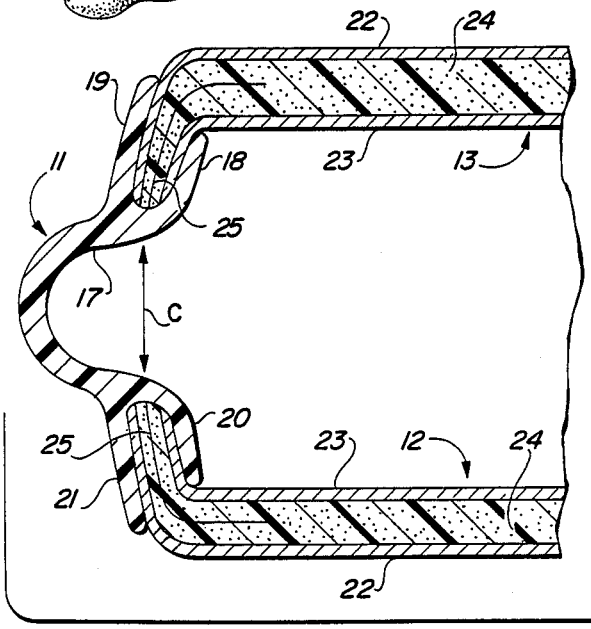
FIG. 2 is a section view of the protective handgun holster of FIG. 1 further illustrating interior construction details thereof and taken along section line 2—2 thereof.
Figure 2:
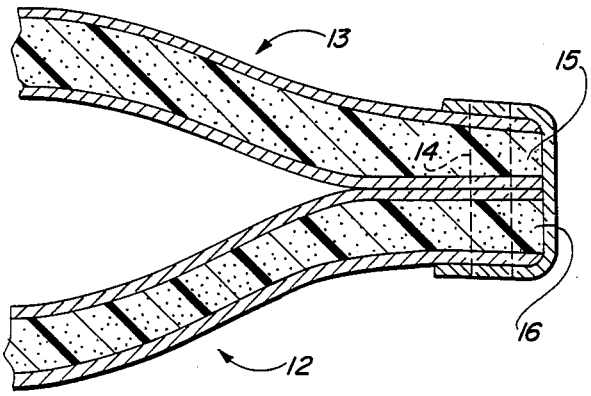

The width of U-shaped groove 17 is indicated in FIG. 2 by arrows C. Spine 11 presently comprises a strip of extruded substantially rigid plastic. The smooth surface of the extruded plastic helps minimize wear of the spine during use of the holster. The holster is sized such that when a gun 50 (FIG. 4) is inserted in the holster the upper portion 51 of the gun contacts flange means 18 and 20 and generates forces against flange means 18, 20 in the directions indicated by arrows D and E in FIG. 4. Spine 11 is resilient such that when forces D and E are generated, flange means 18, 20 are elastically displaced in the directions generally indicated by arrows D and E. This displacement of flange means 18 and 20 causes the width C of U-shaped channel 17 to be increased by the outward movement of the walls of channel 17 in the directions indicated by arrows F and G in FIG. 4. Displacement of flange means 18 and 20 in the direction of arrows D and E also reduces the inner angles 26 and 27 between flange means 18 and 20 and walls 13 and 12, respectively. Consequently, the elastic flexing of the spine 11 when a handgun is inserted in the holster facilitates the conforming of the holster to the gun. When the gun is removed from the holster, flange means 18 and 20 elastically move in directions opposed to arrows D and E and generally return to the positions they were in prior to insertion of gun 50 in the holster. When flange means 18 and 20 return to their original positions, the width C of U-shaped groove 17 also generally returns to its original width C.

Figure 3A:
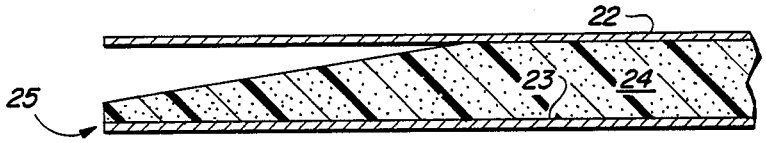
FIG. 3A is a section view illustrating the tapered front edge of a side wall of the holster of the invention.
Figure 3B:
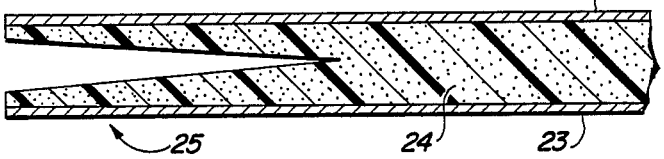
FIG. 3B is a section view illustrating an alternate embodiment of the tapered front edge of a side wall of the holster of the invention.
Figure 3C:
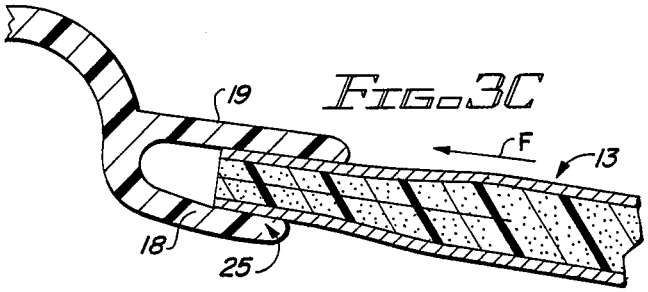
FIG. 3C is a section view illustrating the joining of the tapered front edge of a side wall with resilient flange means of the holster of the invention; and, FIG. 4 is a section view of the holster of FIG. 1 illustrating the mode of operation thereof.
Figure 4:
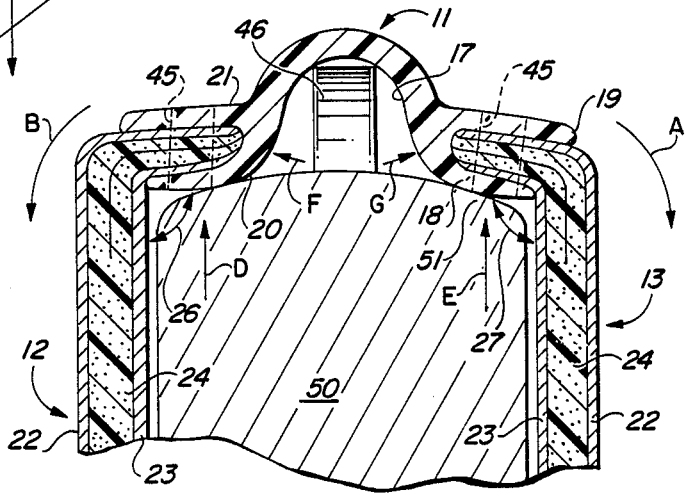

As shown in FIGS. 3A and 3B, a portion of the forward portion of intermediate elastomer layer 24 is removed such that the leading edge 25 of each eall 12, 13 is tapered when leading edge 25 of walls 12, 13 is inserted between flanges 20, 21 and 18, 19, respectively. FIGS. 3C illustrates tapered leading edge 25 of wall 13 being inserted between flange means 18, 19 in the direction of arrow F. Tapering leading edge is important because it facilitates folding of walls 12, 13 around flange means 20, 18 rearwardly in the directions indicated by arrows B and A. If the forward leading edges 25 of walls 12, 13 were of a thickness equivalent to the remaining portions of the walls 12, 13, folding walls 12, 13 rearwardly around flange means 18, 19 would be awkward. The shorter lengths of flange means 18 and 20 with respect to flange means 19 and 21 further facilitates the rearward folding of walls 12, 13 to form inner angles 26 and 27 between the walls and flange means. Leading edges 25 are fastened to flange means 18–21 by stitching 45.

Having described my invention in such terms as to enable those skilled in the art to understand and practice it, and having identified the presently preferred embodiments thereof, I claim:

1. A protective handgun holster for snugly accommodating a handgun selected from a defined range of sizes, said holster including (a) an elongate longitudinal spine including first and second longitudinal outwardly extending resilient flange means; and, (b) a pair of side walls each (i) having a tapered forward edge attached to one of said first and second flange means, and (ii) extending outwardly and rearwardly folded from and at an inner angle with respect to said spine to define a gunreceiving opening, said side walls and spine being shaped and dimensioned such that when a handgun of selected size is inserted in said holster, said flange means are resiliently outwardly displaced to decrease said inner angle between said walls and flange means, said tapered forward edges of said side walls facilitating the rearward folding of said side walls with respect to said flange means to decrease said inner angle between said flange means and said side walls.

* * * * *